US007124463B2

(12) United States Patent
Mathews et al.

(10) Patent No.: US 7,124,463 B2
(45) Date of Patent: Oct. 24, 2006

(54) CONVEYOR LIP FOR MOTORIZED STREET SWEEPER

(75) Inventors: Thomas P. Mathews, Plymouth, MN (US); Michael H. Lenzmeier, North Branch, MN (US); Archie A. Weidner, Minnetonka, MN (US); Gregory J. Engel, Plymouth, MN (US)

(73) Assignee: Tennant Company, Minneapolis, MN (US)

( * ) Notice: Subject to any disclaimer, the term of this patent is extended or adjusted under 35 U.S.C. 154(b) by 583 days.

(21) Appl. No.: 10/236,602

(22) Filed: Sep. 6, 2002

(65) Prior Publication Data

US 2004/0045583 A1 Mar. 11, 2004

(51) Int. Cl.
*E01H 1/04* (2006.01)
*E01H 1/02* (2006.01)

(52) U.S. Cl. ..... 15/84; 15/82; 15/78

(58) Field of Classification Search ..... 15/82–84, 15/78, 246

See application file for complete search history.

(56) References Cited

U.S. PATENT DOCUMENTS

| | | | | | |
|---|---|---|---|---|---|
| 876,727 | A | * | 1/1908 | Pevey | 15/84 |
| 3,008,542 | A | | 11/1961 | Steele | 55/287 |
| 3,604,051 | A | | 9/1971 | Wendel et al. | 15/340 |
| 3,639,940 | A | | 2/1972 | Carlson et al. | 15/352 |
| 3,649,982 | A | * | 3/1972 | Mortensen | 15/84 |
| 3,756,416 | A | | 9/1973 | Wood | 210/408 |
| 3,792,569 | A | | 2/1974 | Carlson et al. | 55/288 |
| 3,881,215 | A | | 5/1975 | Krier et al. | 15/340.1 |
| 3,926,596 | A | | 12/1975 | Coleman | 55/304 |
| 4,017,281 | A | | 4/1977 | Johnstone | 55/334 |
| 4,200,953 | A | * | 5/1980 | Overton | 15/349 |
| 4,578,840 | A | | 4/1986 | Pausch | 15/352 |
| 4,660,248 | A | | 4/1987 | Young | 15/340.1 |
| 4,754,521 | A | | 7/1988 | Zoni | 15/340.1 |
| 4,759,781 | A | | 7/1988 | Olson | 96/427 |
| 5,006,136 | A | | 4/1991 | Wetter | 55/290 |
| 6,035,479 | A | * | 3/2000 | Basham et al. | 15/83 |
| 6,192,542 | B1 | | 2/2001 | Frederick et al. | 15/84 |
| 6,195,836 | B1 | | 3/2001 | Vanderlinden | 15/340.3 |
| 6,195,837 | B1 | | 3/2001 | Vanderlinden | 15/348 |

FOREIGN PATENT DOCUMENTS

| | | |
|---|---|---|
| DE | 1253242 | 12/1967 |
| DE | 1256241 | 12/1967 |
| EP | 0453177 | 4/1991 |
| WO | 03/069071 | 2/2003 |

* cited by examiner

*Primary Examiner*—Gladys J P Corcoran
*Assistant Examiner*—Laura C Guldotti
(74) *Attorney, Agent, or Firm*—Altera Law Group, LLC

(57) ABSTRACT

A street sweeper system is used typically in a motorized vehicle. The sweeper utilizes a cylindrical brush rotating about an axis that is typically perpendicular to the vehicle's direction of motion. A conveyor belt catches debris thrown forwards and upward by the brush and moves the debris to a hopper. A conveyor lip is mounted on a lower edge of the conveyor to improve sweeping performance. The conveyor lip covers a space between the lower edge of the conveyor and the ground. The lip's lower edge is angled towards the brush to deflect debris back towards the brush to recirculate the debris.

8 Claims, 3 Drawing Sheets

CONVEYOR LIP FOR MOTORIZED STREET SWEEPER

FIELD OF THE INVENTION

The present invention relates to motorized street sweeping vehicles.

BACKGROUND OF THE INVENTION

Automated street sweeping vehicles are essential equipment for commercial and government organizations. The vehicles are used for cleaning debris from roadways, walkways, parking lots, runways, and many other ground surfaces.

For streets and highways, large sweepers are primarily used. The large sweepers are motorized (typically diesel powered) and can be custom-made or built upon a commercial truck chassis. The large sweepers typically include large main brushes which direct debris onto a paddled conveyor that moves the debris into a large-capacity debris hopper. The large hoppers allow the sweepers to cover greater distances without the need for emptying the hopper. The large brushes allow the sweeper to pick up larger debris (e.g. rocks, tire treads, wood pieces), thus avoiding the need for multiple passes of the sweeper or manual retrieval of the debris.

Although effective, such street sweepers often miss a certain percentage of the debris, even when the sweeper passes directly over the debris. In some cases, the debris bounces around between the brush and conveyor, and can be ejected out from underneath the vehicle. This is especially problematic with larger debris, as it may not get launched upwards with enough force to hit the conveyor and is more likely to bounce around the conveyor paddles.

During operation, such sweepers can also generate a dust cloud when sweeping. Typically suction is used on side brushes and on the conveyor to control this dust. However, a significant amount of dust is ejected into the atmosphere during sweeping. Besides being a nuisance, the dust is a source of particulate air pollution. In some localities particulate air pollution is a major problem, and municipalities are under government mandates to reduce particulate air pollution.

What is needed is a sweeper that can pick up a higher percentage of road debris, especially large items. Further, the sweeper should reduce the amount of dust ejected into the air. The present invention fulfills these and other needs, and addresses other deficiencies of prior art implementations.

SUMMARY OF THE INVENTION

To overcome the limitations in the prior art described above, and to overcome other limitations that will become apparent upon reading and understanding the present specification, the present invention discloses a sweeper for a ground surface. The sweeper has a front end, a back end and a forward direction of motion. The sweeper includes a debris mover having an outer surface, a ground contact area, and a horizontal axis. The ground contact area is defined where the outer surface of the debris mover contacts the ground surface. The debris mover rotates about the horizontal axis so that the outer surface of the debris mover is moving at least in part towards the front end of the sweeper at the ground contact area.

The sweeper also includes a conveyor mounted forward of the debris mover. The conveyor has a conveyor belt with a collecting surface facing the debris mover. The collecting surface moves at least in part upwards. A collector clearance space is defined between a lower edge of the conveyor and the ground surface. A lip assembly is mounted between the debris mover and the collecting surface of the conveyor belt. The lip assembly has a distal edge proximate the ground surface. The lip assembly substantially covers the collector clearance space.

In one configuration, the sweeper includes a ground gap defined between the distal edge of the lip assembly and the ground surface. The ground gap can measure between 0.75 inches to 1.25 inches.

The lip assembly of the sweeper can include a substantially rigid mounting bracket, a support blade, and a flexible blade. The mounting bracket is coupled to the sweeper adjacent the lower edge of the conveyor. The support blade extends from an edge of the rigid mounting bracket. The flexible blade is located at the distal end of the lip assembly and extends from an edge of the support blade. The mounting bracket may also include a tubular member. The flexible blade may include a plurality of slots at the distal edge. In one arrangement, the plurality of slots are substantially perpendicular to the distal edge.

The lip assembly can be made substantially planar proximate the distal edge. The lip assembly can be oriented so that at least the distal edge of the lip assembly is oriented an angle between 40 and 50 degrees relative to vertical.

In another embodiment of the present invention, a method of street sweeping of a debris from a ground surface involves moving a conveyance in a forward direction on the ground surface. A debris mover of the conveyance is rotated to move the debris at least in part forward of the debris mover. The debris is caught on a conveyor facing the debris mover to collect the debris. The debris is conveyed at least in part upwards on a moving surface of the conveyor facing the debris mover to remove the debris. Debris thrown into a collector clearance space defined between a lower edge of the conveyor and the ground surface is deflected back to recirculate the debris back into the debris mover.

In one aspect of the method, a vacuum is drawn to move an airborne dust from at least the collector clearance space to collect the airborne dust. The method may further involve blocking the airborne dust at the collector clearance space to prevent escape of the airborne dust therethrough.

In another embodiment of the present invention, a mobile sweeping system is usable for removing debris from a ground surface. The sweeping system has a forward direction of motion and a sweeping width. The sweeping system further includes a debris moving means moving debris at least in part forwards across the sweeping width. A conveying means catches a portion of the debris moved by the debris moving means. The conveying means has a collecting surface facing the debris moving means. The collecting surface moves at least in part upwards. A deflecting means covers at least part of a collector clearance space defined between a lower edge of the conveying means and the ground surface. The deflecting means deflects a portion of the debris moved by the debris moving means into the collector clearance space back to the debris moving means.

In one configuration, the deflecting means includes a distal edge adjacent the ground surface and a substantially flexible portion along the distal edge. The substantially flexible portion may include a plurality of slots along the distal edge. The plurality of slots may be substantially perpendicular to the distal edge.

The sweeping system may also include a ground gap between the ground surface and the distal edge of the deflecting means. An air moving means may be included to draw air away from at least the collector clearance space. In one arrangement, the deflecting means causes a restriction of a flow through the collector clearance space. The restriction of flow prevents release of a portion of an airborne dust therethrough.

In another arrangement, the conveying means further includes an exit portion. The sweeping system further includes a collecting means located forward of the conveying means to collect debris from the exit portion of the conveying means.

The above summary of the present invention is not intended to describe each embodiment or every implementation of the present invention. Advantages and attainments, together with a more complete understanding of the invention, will become apparent and appreciated by referring to the following detailed description and claims taken in conjunction with the accompanying drawings.

Figure 1:
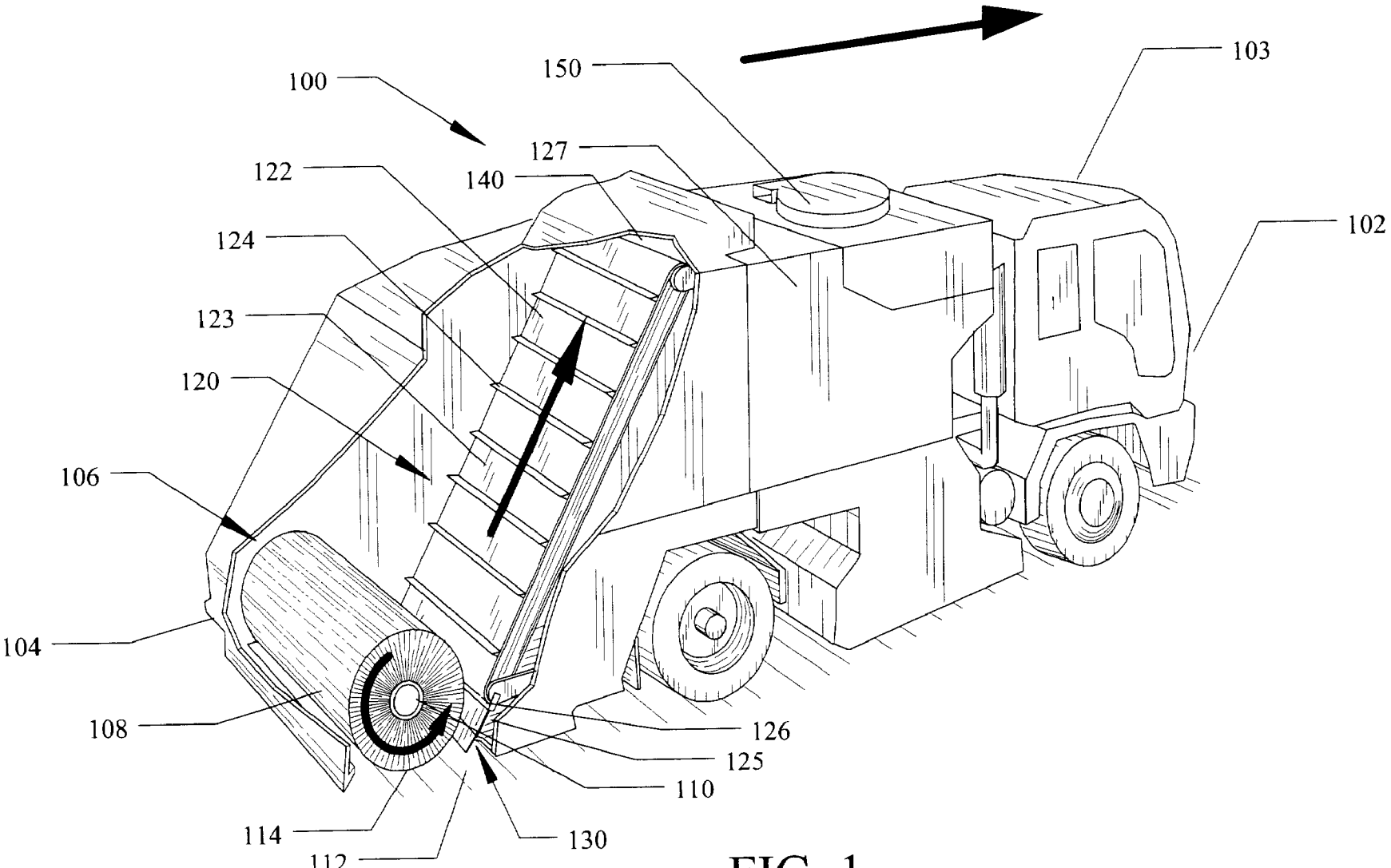
FIG. 1 is a cutaway perspective view of a street sweeper vehicle according to an embodiment of the present invention.

While the invention is amenable to various modifications and alternative forms, specifics thereof have been shown by way of example in the drawings and will be described in detail herein. For example, while the title describes a street sweeper, this refers only to a preferred embodiment since the present invention is applicable to all forms of debris gathering equipment. It is to be understood, however, that the intention is not to limit the invention to the particular embodiments described. On the contrary, the invention is intended to cover all modifications, equivalents, and alternatives falling within the scope of the invention as defined by the appended claims.

DETAILED DESCRIPTION OF THE VARIOUS EMBODIMENTS

In the following description of the illustrated embodiments, references are made to the accompanying drawings which form a part hereof, and in which is shown by way of illustration, various embodiments in which the invention may be practiced. It is to be understood that other embodiments may be utilized and structural and functional changes may be made without departing from the scope of the present invention.

Referring now to FIG. 1, a street sweeping vehicle, generally indicated by reference numeral 100, has a front end 102 and back end 104. The front end 102 of the vehicle includes a cab section 103 where an operator sits A debris mover, typically a cylindrical pickup brush and generally indicated by reference numeral 106, is mounted near the back end 104 of the vehicle 100. The brush 106 includes bristles 108 and a hub 110. The centerline of the brush 106 is oriented substantially perpendicular to the direction of forward motion of the vehicle 100, indicated by the bold, straight arrow above the vehicle 100. It is appreciated, however, that the brush 106 can be oriented skewed (i.e. non-perpendicular to forward motion) to push debris both forwards and sideways.

The brush 106 is powered and rotates in the direction indicated by the bold, curved arrow. It is appreciated that the brush 106 can be rotated opposite the direction indicated in FIG. 1, although such a rotation is likely to be less effective. The brush 106 can rotate at varying speeds, typically in the range of 75 to 150 rpm. The brush 106 in this example has an outer diameter ranging from 36 to 18 inches (91 to 45 cm), the outer diameter decreasing with wear of the bristles 108. The outer surface of the brush 106 (i.e. at the tip of the bristles 108) contacts the ground surface 112 at a contact surface 114. The brush 106 throws debris from the ground surface 112 to a debris collector (in this example a conveyor), generally indicated by reference numeral 120.

The conveyor 120 includes a belt 122 with paddles or cleats 124 mounted along an outer surface at regularly spaced intervals. Debris is thrown by the brush 106 onto a collecting surface 123 of the belt 122. The belt 122 rotates in a direction counter to rotation of the broom 106 such the collecting surface 123 of the belt 122 moves at least in part upwards (and typically forwards as well) away from the brush 106, as indicated by the angled arrow located over the belt 122. The debris leaves an exit area 140 at the top of the conveyor 120 and drops into a hopper 127. Belt 122 is driven by drive wheel 206 which rotates on an axis which defines the midpoint between the upper and lower surfaces of the conveyor.

In the sweeping vehicle 100 according to the present invention, a conveyor lip 130 is mounted adjacent a bottom edge 126 of the conveyor 120. The conveyor lip 130 covers at least in part a collector clearance space 125 defined between the bottom edge 126 and the ground surface 112 along the width of the conveyor 120. The conveyor lip 130 improves the sweeping performance of the sweeper 100 and helps contain dust at least within the enclosed space between the brush 106 and conveyor 120.

Conceptually, the conveyor lip 130 is a structural element that prevents debris thrown by the brush 106 from colliding with a counter rotating cleat 124 and being batted over the brush 106. The conveyor lip 130 also serves as a device to improve the trajectory of debris so the debris can land on the belt 122 rather than be thrown under the conveyor 120.

Figure 2:
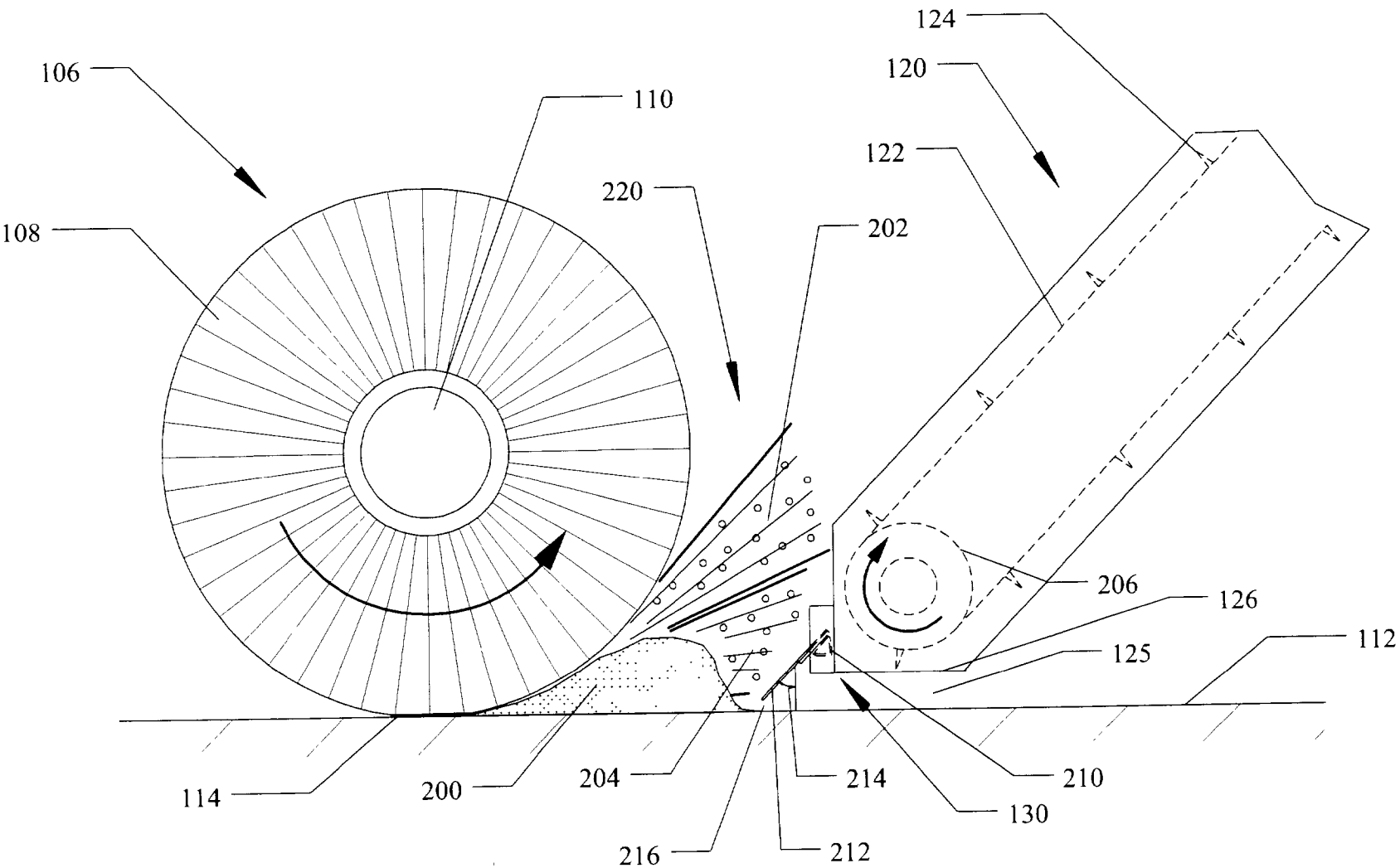
FIG. 2 is a side view of the brush, conveyor and conveyor lip according to an embodiment of the present invention.

Turning now to FIG. 2, a side view of the sweeping system illustrates the benefits of the conveyor lip 130. The brush 106 contacts the ground at the contact surface 114 as it is being rotated in the direction indicated by the curved arrow. If there is a large amount of debris, the rotation of the brush 106 at the contact surface 114 may build up a "wedge" 200 of debris as the vehicle 100 moves forward. Most of the debris is thrown upwards in a debris path 202 tangential to the brush 106 where the brush 106 contacts a top portion of the wedge 200. This portion of the debris lands on the belt 122 and is carried into the hopper 127.

If there is not enough debris to form a wedge 200 of sufficient size, debris can be thrown in a path 204 that is more parallel to the ground surface 112. The debris may shoot forward under the conveyor's lower edge 126. The debris may collide also with a counter-rotating cleat 124 and be batted up and over the brush 106 where it can be left on the ground surface 112 behind the machine 100. Also, since heavier debris (e.g. rocks from 2 cm to 5 cm in diameter) is more prone to travel along the lower path 204, the heavier debris tends to reciprocate in a sweeping space 220 between the brush 106 and conveyor 120. The more that debris reciprocates between the brush 106 and conveyor 120, the more likely it is to be batted over the brush 106 by a counter-rotating cleat 124 or be launched in a direction (e.g.

sideways, backwards) where it is missed by the brush 106 and left on the ground surface 112.

The conveyor lip 130 has been found to help reduce collisions with counter-rotating cleats and reciprocation of debris between the brush 106 and conveyor 120, as well as preventing debris from being ejected underneath the conveyor 120. The conveyor lip 130 typically includes at least a rigid mounting bracket 210 and a flexible blade or skirt 212. The mounting bracket 210 attaches adjacent to the lower edge 126 of the conveyor 120 at an angle 214 relative to vertical. The mounting bracket 210 can either be attached to the conveyor 120 or to any part of the surrounding structure. The mounting bracket 210 extends along the width of the conveyor 120 and forms a rigid blocking member in front of and below the conveyor 120. The conveyor lip 130 thereby covers the collector clearance space 125 between the ground surface 112 and the conveyor's lower edge 126.

The conveyor lip 130 may be configured so that a ground clearance gap 216 exists between the flexible blade 212 and the ground surface 112. The ground clearance gap 216 prevents dust and small debris from accumulating on the flexible blade 212 and lessens wear on the flexible blade 212. The flexible blade 212 is compliant enough that material that is larger than the clearance gap 216 will deflect the flexible blade 212 upwards so that debris does not get swept forward by the flexible blade 212 and can thereby reach the brush 106.

It is appreciated that the collector clearance space 125 is a potential escape route for airborne dust that is moved forwards by the brush's rotation. Because the conveyor lip 130 substantially blocks the collector clearance space 125, the conveyor lip 130 prevents the airborne dust from escaping, tending to trap the dust within the sweeping space 220. The vehicle 100 may also include a vacuum system 150 (best seen in FIG. 1) to pull dust from at least the sweeping space 220 between the conveyor 120 and brush 106. The conveyor lip 130 creates a restriction of outside air flowing through the sweeping space 220, and thereby helps retain the dust in the sweeping space 220 so that it can be more thoroughly removed by the vacuum system 150.

Figure 3:
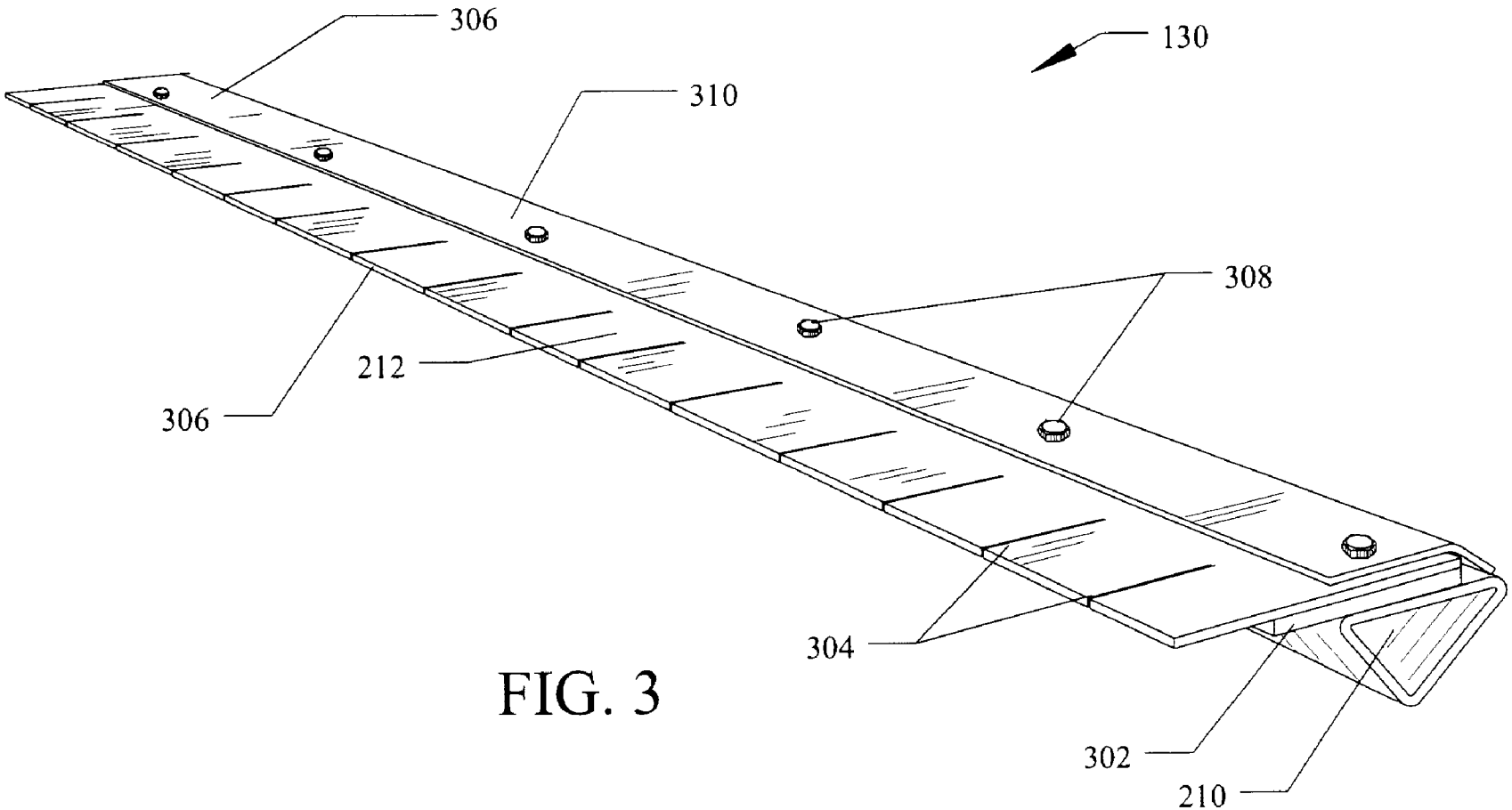
FIG. 3 is a perspective view of the conveyor lip according to an embodiment of the present invention.

Turning now to FIG. 3, a particularly useful embodiment of a conveyor lip 130 is shown. The mounting bracket 210 can be formed from sheet metal, in this example 3/16 inch (4.8 mm) thick carbon steel. The mounting bracket 210 is formed into a tubular structure which gives it strength to resist damage yet keeps the bracket's weight acceptably low. An equivalent strength aluminum sheet may be used where even lower weight or corrosion resistance is desired. A support blade 302 made of relatively thick rubber (e.g. 3/16 inch (4.8 mm) 3-ply rubber) may be sandwiched between the mounting bracket 210 and flexible blade 212, extending out past the mounting bracket 210. The support blade 302 is relatively flexible, yet will not droop down when mounted.

In this configuration, the flexible blade 212 is mounted on top of the support blade 302 and extends past an edge of the support blade 301. The flexible blade 212 is formed from a relatively compliant belted rubber, such as 1/8 inch thick (3 mm) bias 2-ply belted sheet rubber. The flexible blade 212 may include edge slots 304 evenly spaced along the distal edge 306 of the conveyor lip 130. The slots 304 allow large debris that is passing under the lip 130 to deflect only a small, local portion of the flexible blade 212 so that the remainder of the flexible blade 212 remains substantially undeformed, and therefore continues to deflect debris back onto the brush 106. The edge slots 304 shown are substantially perpendicular to a distal edge of the conveyor lip 308, although it is appreciated that the slots 304 can be formed at a non-perpendicular angle relative to the distal edge 306.

The flexible blade 212 and support blade 302 are attached to the mounting bracket 210 by fasteners 308 (e.g. bolts) and a clamping bracket 310. The mounting bracket 210 can be mounted to the vehicle 100 by using fasteners or by other means such as welding. It is appreciated that the flexible blade 212 and/or support blade 302 are removably mounted with bolts 308 at least for maintenance purposes. It may also be desired to remove the blades 212, 302 for certain tasks such as sweeping up leaves or other lightweight debris. More elaborate quick release methods of blade mounting may be used, although inexpensive and reliable fasteners such as bolts 308 are usually sufficient for assembling and attaching the blades 212, 302. It is also appreciated the conveyor lip 130 provides some benefit even with one or both blades 212, 302 removed.

Referring back to FIG. 2, the lip 130 is mounted at an angle 214 relative to vertical. It has been found that a mounting angle 214 of between 20 and 70 degrees is most effective (preferably 40 to 50 degrees), allowing larger debris to pass easily under the flexible blade 212 while deflecting a large portion of wayward debris back to the brush 106 for re-collection. A clearance gap of between 0.75 and 1.25 inches (1.9 and 3.2 cm) has been found to provide an optimum balance between debris collection and blade wear/damage over convoluted surfaces.

Although the sweeping system of the present invention has been described in conjunction with a self propelled vehicle 100, it is appreciated that a brush 106, conveyor 120, and conveyor lip 130 can be used in any conveyance, such as trailers or push sweepers. The conveyor lip 130 can also be used on smaller sweeping systems that have alternate conveyor (debris collector) 120 embodiments, such as an auger conveyor or a suction plenum. The conveyor lip 130 can also be used in systems that do not have a conveyor, such as systems that throw the debris directly into a hopper.

It will, of course, be understood that various modifications and additions can be made to the preferred embodiments discussed hereinabove without departing from the scope of the present invention. Accordingly, the scope of the present invention should not be limited by the particular embodiments described above, but should be defined only by the claims set forth below and equivalents thereof.

What is claimed is:

1. A mobile sweeping system for removing a debris from a ground surface, the sweeping system having a forward direction of motion and a sweeping width, the sweeping system further comprising:

a debris moving means moving a debris at least in part forwards across the sweeping width;

a conveying means having an upper and lower surface and a midpoint therebetween catching a portion of the debris moved by the debris moving means, the conveying means having a collecting surface facing the debris moving means, the collecting surface moving at least in part upwards; and a deflecting means covering at least part of a collector clearance space defined between a lower edge of the conveying means and the ground surface, the deflecting means deflecting a portion of the debris moved by the debris moving means into the collector clearance space back to the debris moving means, said deflecting means including an elongated flexible blade having a plurality of slits extending from its distal edge, said slits permitting the blade to partially deform when striking an object so the remainder of the blade remains undeformed; said deflecting means mounted to the conveying means above the midpoint but below the upper surface, and wherein the conveying means further comprises an exit portion, the sweeping system further comprising a collecting means located forward of the conveying means to collect debris from the exit portion of the conveying means.

2. A sweeper for a ground surface having a front end, a back end and a forward direction of motion, the sweeper comprising:

a debris mover comprising:

an outer surface;

a ground contact area where the outer surface of the debris mover contacts the ground surface; and a horizontal axis, the debris mover rotating about the horizontal axis so that the outer surface of the debris mover is moving at least in part towards the front end of the sweeper at the ground contact area;

a conveyor mounted forward of the debris mover, the conveyor comprising a conveyor belt, the conveyor belt having an upper collecting surface facing the debris mover, the collecting surface moving at least in part upwards and a lower return surface and at least one drive roller therebetween, the drive roller rotating on an axis which generally defines the midpoint between the upper and lower surfaces;

a collector clearance space defined between a lower edge of the conveyor and the ground surface; and a lip assembly having its leading edge mounted to the conveyor above the axis of the drive roller but below the upper collecting surface of the debris remover, the lip assembly having a distal edge proximate the ground surface, the lip assembly substantially covering the collector clearance space;

a substantially rigid mounting bracket coupled to the sweeper adjacent the lower edge of the conveyor which maintains a support blade in a substantially fixed angle relative to said conveyor despite impingement of debris on a flexible blade;

said support blade extending from an edge of the rigid mounting bracket; and said flexible blade at the distal end of the lip assembly, the flexible blade extending from an edge of the support blade.

3. The sweeper of claim 2, further comprising a ground gap defined between the distal edge of the lip assembly and the ground surface.

4. The sweeper of claim 3, wherein the ground gap measures between 0.75 inches to 1.25 inches.

5. The sweeper of claim 1, wherein the flexible blade comprises a plurality of slots at the distal edge.

6. The sweeper of claim 5, wherein the plurality of slots are substantially perpendicular to the distal edge.

7. The sweeper of claim 1, wherein the lip assembly is substantially planar proximate the distal edge.

8. The sweeper of claim 1, wherein at least the distal edge of the lip assembly is oriented an angle between 40 and 50 degrees relative to vertical.

* * * * *